US011414951B2

(12) United States Patent
Hartman et al.

(10) Patent No.: US 11,414,951 B2
(45) Date of Patent: Aug. 16, 2022

(54) ACTUATING TOOL FOR ACTUATING AN AUXILIARY TOOL DOWNHOLE IN A WELLBORE

(71) Applicant: Oso Perforating, LLC, Irving, TX (US)

(72) Inventors: Tobias Hartman, Frisco, TX (US); Varun Garg, Dallas, TX (US); Jeremy Ursi, Frisco, TX (US); Daniel Schmidt, Moore, OK (US)

(73) Assignee: OSO PERFORATING, LLC, Irving, TX (US)

( * ) Notice: Subject to any disclaimer, the term of this patent is extended or adjusted under 35 U.S.C. 154(b) by 0 days.

(21) Appl. No.: 17/365,178

(22) Filed: Jul. 1, 2021

(65) Prior Publication Data

US 2022/0003066 A1 Jan. 6, 2022

Related U.S. Application Data

(60) Provisional application No. 63/047,062, filed on Jul. 1, 2020.

(51) Int. Cl.

| | |
|---|---|
| ***E21B 33/10*** | (2006.01) |
| ***E21B 17/02*** | (2006.01) |
| ***E21B 23/00*** | (2006.01) |
| *E21B 43/116* | (2006.01) |
| *E21B 43/26* | (2006.01) |

(52) U.S. Cl.

CPC ..... *E21B 33/10* (2013.01); *E21B 17/028* (2013.01); *E21B 23/00* (2013.01); *E21B 43/116* (2013.01); *E21B 43/2607* (2020.05)

(58) Field of Classification Search

CPC ..... E21B 33/10; E21B 23/00; E21B 17/028; E21B 43/2607; E21B 43/116

See application file for complete search history.

(56) References Cited

U.S. PATENT DOCUMENTS

| | | | | |
|---|---|---|---|---|
| 4,552,218 | A | 11/1985 | Ross et al. | |
| 5,240,077 | A | 8/1993 | Whitsitt | |
| 6,173,786 | B1 * | 1/2001 | Sampson | E21B 23/04 166/383 |
| 2002/0096325 | A1 * | 7/2002 | Sonnier | E21B 47/18 166/255.3 |
| 2007/0056745 | A1 * | 3/2007 | Contant | E21B 47/18 166/382 |
| 2007/0272415 | A1 | 11/2007 | Ratcliff et al. | |
| 2008/0283252 | A1 | 11/2008 | Guignard et al. | |
| 2012/0037360 | A1 * | 2/2012 | Arizmendi, Jr | E21B 23/04 166/250.01 |
| 2012/0279722 | A1 | 11/2012 | Murray et al. | |
| 2013/0306328 | A1 * | 11/2013 | Maguire | E21B 23/04 166/381 |

OTHER PUBLICATIONS

International Search Report and Written Opinion for corresponding International Application No. PCT/US2021/040112 dated Oct. 6, 2021; 10 pages.

* cited by examiner

*Primary Examiner* — Steven A MacDonald
(74) *Attorney, Agent, or Firm* — Haynes and Boone, LLP

(57) ABSTRACT

An actuating tool actuable by degradation of at least a portion of a seal assembly to set an auxiliary tool downhole in an oil and gas wellbore. A system and method for actuating the auxiliary tool downhole in the oil and gas wellbore using the actuating tool by degrading at least a portion of the seal assembly of the actuating tool.

28 Claims, 10 Drawing Sheets

ACTUATING TOOL FOR ACTUATING AN AUXILIARY TOOL DOWNHOLE IN A WELLBORE

CROSS-REFERENCE TO RELATED APPLICATION

This application claims the benefit of the filing date of, and priority to, U.S. Application No. 63/047,062, filed Jul. 1, 2020, the entire disclosure of which is hereby incorporated herein by reference.

BACKGROUND

The present disclosure relates generally to oil and gas operations and, more particularly, to an actuating tool for actuating an auxiliary tool downhole in a wellbore.

DETAILED DESCRIPTION

Figure 1:
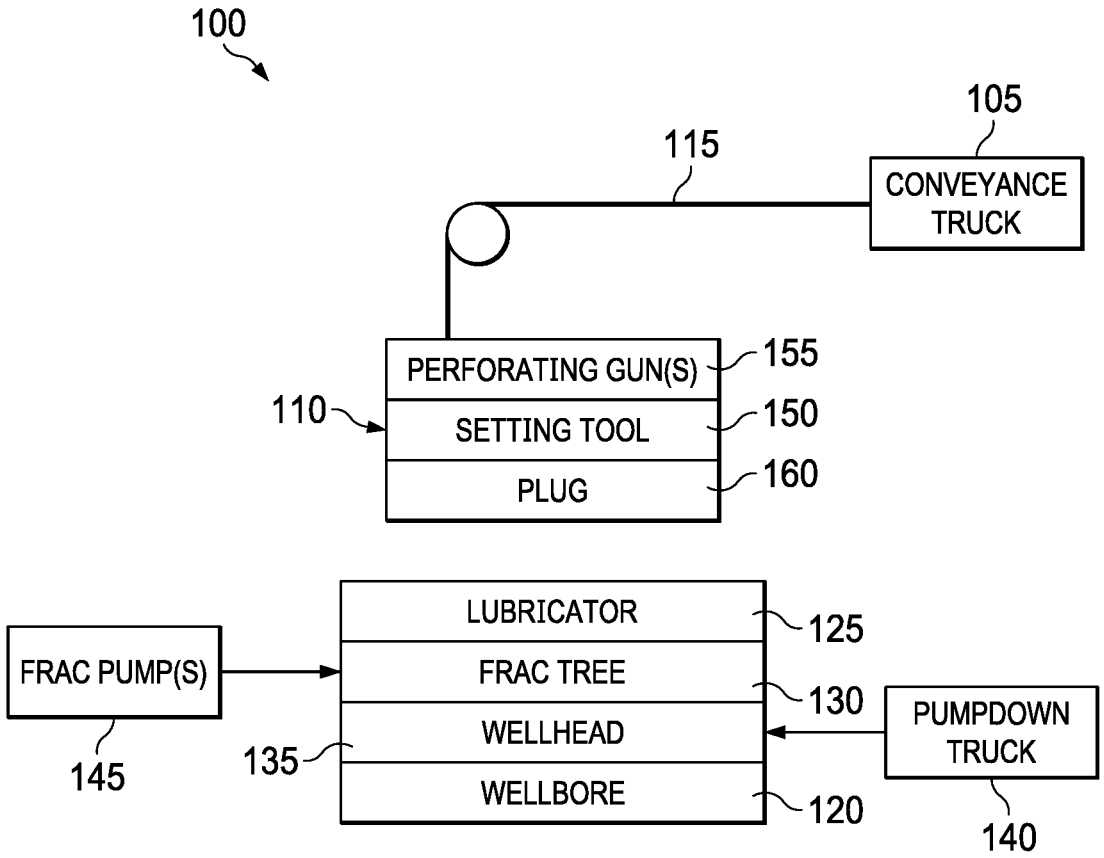
FIG. 1 is a diagrammatic illustration of a system, the system including a downhole tool, according to one or more embodiments.

FIG. 1 is a diagrammatic illustration of a system, according to one or more embodiments. Referring to FIG. 1, in an embodiment, the system is generally referred to by the reference numeral 100 and includes a conveyance truck 105 and a downhole tool 110. The conveyance truck 105 is operable to deploy and retrieve the downhole tool 110 via a conveyance string 115. The conveyance string 115 may be or include any type of conveyance string capable of being connected to the downhole tool 110 and conveyed together therewith into an oil and gas wellbore 120 that penetrates one or more subterranean formations. The wellbore 120 may be used in oil and gas exploration and production operations. The conveyance string 115 may include, but is not limited to, casing, drill pipe, coiled tubing, production tubing, other types of pipe or tubing strings, and/or other types of conveyance strings, such as wireline, slickline, or the like. In one or more embodiments, the conveyance string 115 is wireline and the conveyance truck 105 is a wireline truck. In one or more other embodiments, the conveyance string 115 is coiled tubing and the conveyance truck 105 is a coiled tubing truck.

As shown in FIG. 1, the system 100 further includes a lubricator 125, a fracturing (or "frac") tree 130, and a wellhead 135. The wellhead 135 is located at the top or head of the wellbore 120. A pumpdown truck 140 may be connected to, and adapted to be in fluid communication with, the wellhead 135. The pumpdown truck 140 is operable to supply pumpdown fluid to the wellhead 135, which pumpdown fluid urges the downhole tool 110 downhole along the wellbore 120 (e.g., along a horizontal section of the wellbore 120). In addition to, or instead of, being connected to, and adapted to be in fluid communication with, the wellhead 135, the pumpdown truck 140 may be connected to, and adapted to be in fluid communication with, the frac tree 130 and/or the lubricator 125. In those embodiments in which the pumpdown truck 140 is connected to, and in fluid communication with, the lubricator 125, the pumpdown truck 140 may be further utilized to equalize pressure between the wellhead 135 and the lubricator 125 to thereby facilitate the opening of a valve (e.g., a swab valve, an upper master valve, the like, or a combination thereof) isolating the lubricator 125 from the wellhead 135 so that the downhole tool 110 may be deployed from the lubricator 125, through the wellhead 135, and into the wellbore 120, as will be described in further detail below. In addition to, or instead of, the pumpdown truck 140, a bypass line and/or a different pump may be utilized to equalize pressure between the wellhead 135 and the lubricator 125 to thereby facilitate the opening of the valve isolating the lubricator 125 from the wellhead 135. The pumpdown truck 140 is needed in those instances where the conveyance string 115 is insufficiently rigid to move the downhole tool 110 downhole along the wellbore 120 (e.g., when the conveyance string 115 is wireline). Alternatively, the pumpdown truck 140 may be omitted from the system 100 in those instances where the conveyance string 115 is sufficiently rigid to move the downhole tool 110 downhole along the wellbore 120.

The frac tree 130 is connected to, and adapted to be in fluid communication with, the wellhead 135, opposite the wellbore 120. For example, the frac tree 130 may be, include, or be part of the wellhead 135. One or more frac pumps 145 are connected to, and adapted to be in fluid communication with, the frac tree 130. The frac pump(s) 145 are operable to supply fracturing fluid to the wellbore 120 during a hydraulic fracturing operation, as will be described in further detail below. During such a hydraulic fracturing operation, the fracturing fluid is utilized to hydraulically fracture a target zone of a subterranean formation adjacent a perforated zone of the wellbore 120. The lubricator 125 is connected to, and adapted to be in fluid communication with, the frac tree 130, opposite the wellhead 135. The lubricator 125 facilitates deployment of the downhole tool 110 through the wellhead 135 and into the wellbore 120 to a location proximate the target zone of the subterranean formation.

The downhole tool 110 includes an actuating tool 150. In one or more embodiments, the actuating tool 150 is, includes, or is part of a setting tool. The downhole tool 110 is deployable from the lubricator 125, through the wellhead 135, and into the wellbore 120 to a location proximate the target zone of the subterranean formation, as will be described in further detail below. In one or more embodiments, as in FIG. 1, the downhole tool 110 further includes an auxiliary tool. In one or more embodiments, the auxiliary tool is or includes one or more perforating guns 155 and a plug 160. In such instances, the downhole tool 110 is deployable from the lubricator 125, through the wellhead 135, and into the wellbore 120 to the location proximate the target zone of the subterranean formation to perform a plug-and-perforate operation, as will be described in further detail below. Although described herein as including the perforating gun(s) 155, the actuating tool 150, and the plug 160 for use during a plug-and-perforate operation, the downhole tool 110 may instead be another type of downhole tool of which the actuating tool 150 is a part for use in connection with another application, which application may include, but is not limited to, exploration, drilling, completions, production, measurement, logging, the like, or a combination thereof. More particularly, although described herein as including the perforating gun(s) 155 and the plug 160, the perforating gun(s) 155, the plug 160, or both may be omitted from the auxiliary tool and replaced with one or more other downhole tools such as, for example, one or more flow control tools.

The perforating gun(s) 155 are connected to the conveyance string 115 at an end of the conveyance string 115 opposite the conveyance truck 105. Moreover, the actuating tool 150 is connected to the perforating gun(s) 155, opposite the conveyance string 115, and the plug 160 is connected to the actuating tool 150, opposite the perforating gun(s) 155. The plug 160 is actuable (e.g., radially expandable) by the actuating tool 150 as part of the plug-and-perforate operation at a location proximate the target zone of the subterranean formation, as will be described in further detail below. Finally, the perforating gun(s) 155 are operable as part of the plug-and-perforate operation to perforate the wellbore 120 (e.g., a casing string cemented into the wellbore 120) proximate the target zone of the subterranean formation, as will be described in further detail below.

Figure 2:
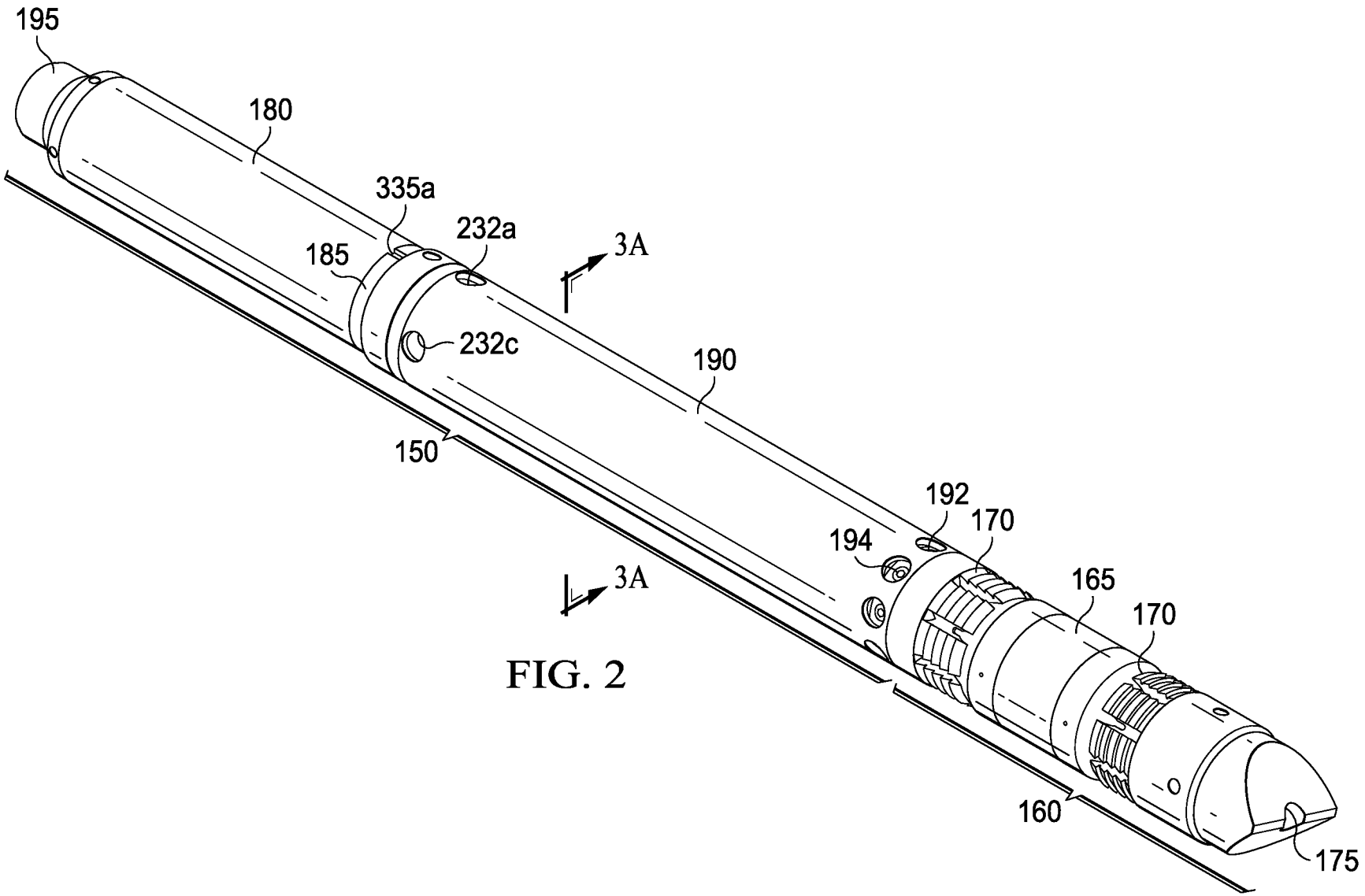
FIG. 2 is a perspective view of an actuating tool and an auxiliary tool of the downhole tool of FIG. 1, according to one or more embodiments.

FIG. 2 is a perspective view of the actuating tool 150 and the plug 160, according to one or more embodiments. Referring to FIG. 2, in an embodiment, the plug 160 includes a packer element 165 and a plurality of slip elements 170. The packer element 165 is actuable by the actuating tool 150 as part of the plug-and-perforate operation to seal against a wall of the wellbore 120 (e.g., a casing string cemented in the wellbore 120, an open hole section of the wellbore, the like, or a combination thereof). Likewise, the slip elements 170 are actuable by the actuating tool 150 as part of the plug-and-perforate operation to anchor the plug 160 to the wall of the wellbore 120. The plug 160 further includes a central passage 175 extending therethrough, which central passage 175 is closable as part of the fracturing operation by seating an obturator in the plug 160, as will be described in further detail below. As shown in FIG. 2, the actuating tool 150 includes a main housing 180, a housing retainer 185 (which may also be referred to as a "sub" or an "end cap"), and an auxiliary sleeve 190. In one or more embodiments, the auxiliary sleeve 190 is, includes, or is part of a setting sleeve. The auxiliary sleeve 190 is connected between the housing retainer 185 to the plug 160. Radial openings 192 are formed through the auxiliary sleeve 190 adjacent the plug 160 to permit the insertion of fasteners 194 such as, for example, shear pins, therethrough, which fasteners 194 connect the plug 160 to the actuating tool 150. The main housing 180 is connected to the housing retainer 185, opposite the auxiliary sleeve 190. Finally, in one or more embodiments, a conductor sub (not shown) is connected to the main housing 180, opposite the housing retainer 185.

Figure 3A:
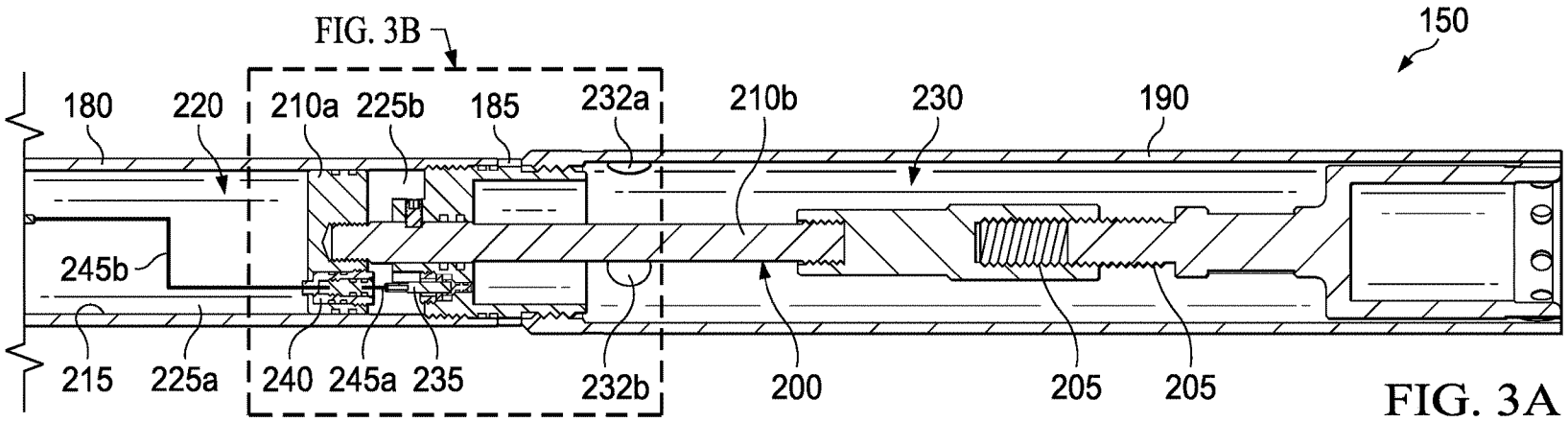
FIG. 3A is a cross-sectional view of the actuating tool of FIG. 2 taken along the line 3A-3A in FIG. 2, according to one or more embodiments.

FIG. 3A is a cross-sectional view of the actuating tool 150 taken along the line 3A-3A in FIG. 2, according to one or more embodiments. Referring to FIG. 3A, with continuing reference to FIG. 2, in an embodiment, the actuating tool 150 further includes a piston 200 and a plug adapter 205. The piston 200 includes a piston head 210*a* and a piston rod 210*b*. The piston head 210*a* is connected to the piston rod 210*b* and extends within the main housing 180. In one or more embodiments, the piston head 210*a* and 210*b* are integrally formed as a unitary component. The main housing 180 defines an internal passage 215 sealed on opposing ends by the conductor sub (not shown) and the housing retainer 185, respectively, to form a chamber 220 (e.g., an atmospheric chamber). In one or more embodiments, the main housing 180 and the housing retainer 185 are integrally formed as a unitary component. The piston head 210*a* sealingly engages the main housing 180, thereby dividing the chamber 220 into opposing sub-chambers 225*a* and 225*b*. The auxiliary sleeve 190 defines an internal passage 230 sealed on one end by the housing retainer 185. Radial openings 232*a-c* (the radial opening 232*c* is shown in FIG. 2) are formed through the auxiliary sleeve 190 into the internal passage 230. The radial openings 232*a-c* are operable to communicate wellbore pressure from the wellbore 120 to the internal passage 230, as will be described in further detail below. In addition to, or instead of, being communicated from the wellbore 120 to the internal passage 230 via the radial openings 232*a-c*, the wellbore pressure may be otherwise communicated from the wellbore 120 to the internal passage 230; in one or more such embodiments, the radial openings 232*a-c* are omitted.

The piston rod 210*b* extends from the piston head 210*a* in the main housing 180 and into the internal passage 230 of the auxiliary sleeve 190. The plug adapter 205 is connected to the piston rod 210*b*, opposite the piston head 210*a*, and extends within the internal passage 230 of the auxiliary sleeve 190. The plug 160 (not visible in FIG. 3A) is connected to the plug adapter 205, opposite the piston rod 210*b*, using the fasteners 194 so that the packer element 165 and the slip elements 170 extend outside the auxiliary sleeve 190, as shown in FIG. 2. In addition to, or instead of, the fasteners 194, the plug 160 may be connected to the plug adapter 205 using detents, protrusions, slots, ridges, grooves, ridges, the like, or a combination thereof. A seal assembly 235 engages the housing retainer 185 to prevent, or at least reduce, fluid communication between the internal passage 230 of the auxiliary sleeve 190 and the sub-chamber 225*b*, as will be described in further detail below. A conductive fitting 240 extends through the piston head 210*a* and between the sub-chambers 225*a* and 225*b*. An electrical conductor 245*a* (e.g., a wire) connects the conductive fitting 240 extending through the piston head 210*a* to the seal assembly 235, as will be described in further detail below. An electrical conductor 245*b* (e.g., a wire) connects the conductive fitting 240 extending through the piston head 210*a* to the conductor sub (not shown).

Figure 3D:
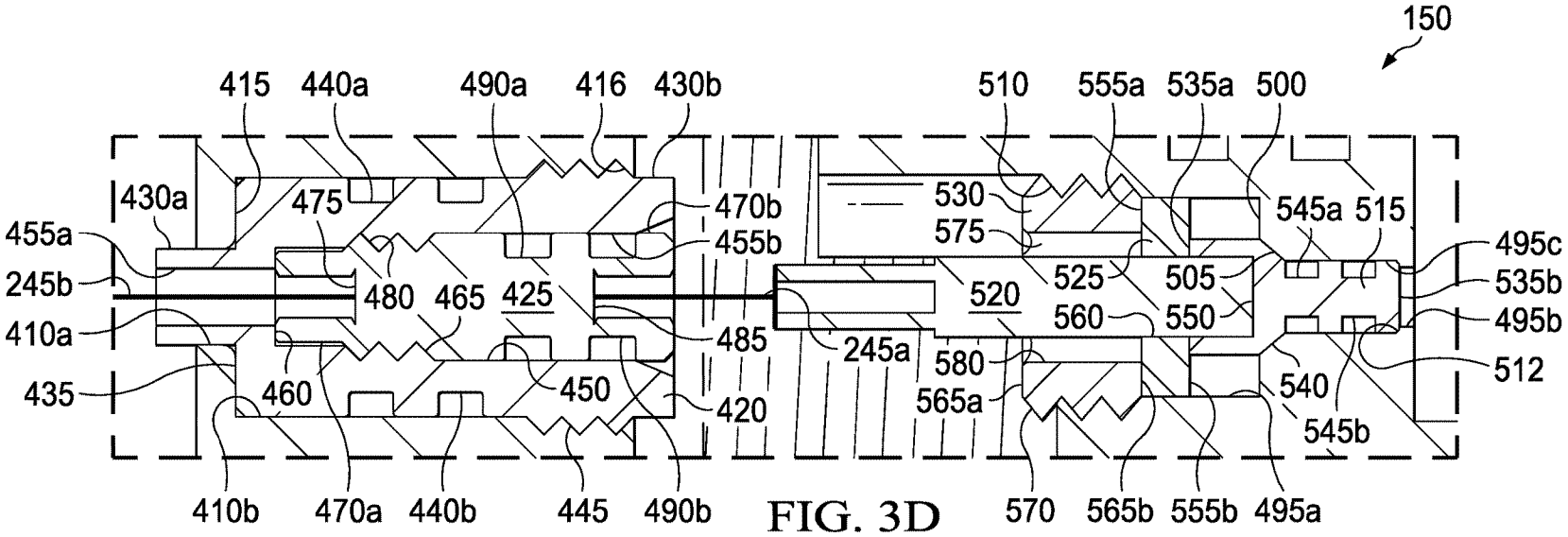
FIG. 3D is an enlarged view of a portion of the actuating tool shown in FIG. 3B, according to one or more embodiments.
Figure 3B:
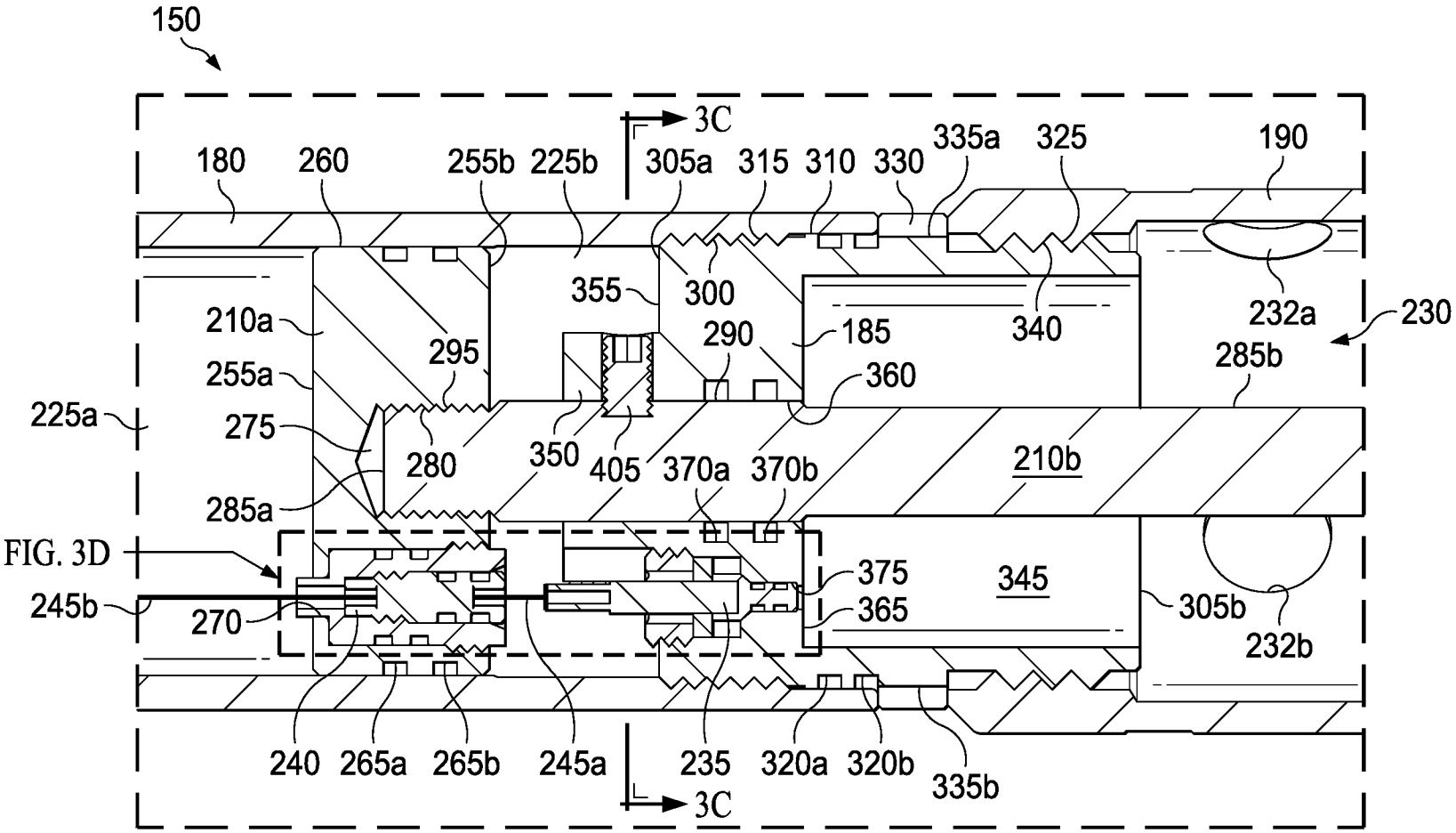
FIG. 3B is an enlarged view of the cross-sectional view of the actuating tool shown in FIG. 3A, according to one or more embodiments.

FIG. 3B is an enlarged view illustrating a portion of the actuating tool 150 shown in FIG. 3A, according to one or more embodiments. Referring to FIG. 3B, with continuing reference to FIG. 3A, in an embodiment, the piston head 210*a* defines opposing end portions 255*a* and 255*b* and an outer surface 260. In one or more embodiments, the piston head 210*a* is generally cylindrical. External annular grooves 265*a* and 265*b* are formed into the outer surface 260 of the piston head 210*a*, which external annular grooves 265*a* and 265*b* are each adapted to accommodate a sealing element enabling the piston head 210*a* to sealingly engage the main housing 180, thereby dividing the chamber 220 into the sub-chambers 225*a* and 225*b*. An opening 270 is formed through the piston head 210*a* between the sub-chambers 225*a* and 225*b*. The conductive fitting 240 extends within the opening 270 and sealingly engages the piston head 210*a*. A blind hole 275 is formed into the end portion 255*b* of the piston head 210*a*, which blind hole 275 only extends partially through the piston head 210*a*. An internal threaded connection 280 is formed in the piston head 210*a* at the blind hole 275.

The piston rod 210*b* defines opposing end portions 285*a* and 285*b* and an outer surface 290. In one or more embodiments, the piston rod 210*b* is generally cylindrical. An external threaded connection 295 is formed in the outer surface 290 of the piston rod 210*b* at the end portion 285*a*. The external threaded 295 connection of the piston rod 210*b* threadably engages the internal threaded connection 280 of the piston head 210*a* to thereby connect the piston head 210*a* to the piston rod 210*b* at the end portion 285*a* of the piston rod 210*b*.

The main housing 180 includes an internal threaded connection 300 at an end portion thereof opposite the conductor sub (not shown). The housing retainer 185 defines opposing end portions 305*a* and 305*b* and an outer surface 310. An external threaded connection 315 is formed in the outer surface 310 of the housing retainer 185 at the end portion 305*a*. The external threaded connection 315 of the housing retainer 185 engages the internal threaded connection 300 of the main housing 180 to connect the housing retainer 185 to the main housing 180. External annular grooves 320*a* and 320*b* are formed into the outer surface 310 of the housing retainer 185, which external annular grooves 320*a* and 320*b* are each adapted to accommodate a sealing element enabling the housing retainer 185 to sealingly engage the main housing 180. Likewise, an external threaded connection 325 is formed in the housing retainer 185 at the end portion 305*b*.

The housing retainer 185 includes a collar 330 extending outwardly from the outer surface 310 between the external annular grooves 320*a* and 320*b* and the external threaded connection 315. In one or more embodiments, the external threaded connection 315 of the housing retainer 185 is threaded into the internal threaded connection 300 of the main housing 180 until the collar 330 of the housing retainer 185 engages the end portion of the main housing 180 opposite the conductor sub (not shown). Spanner slots 335*a* and 335*b* are formed radially into the collar 330 (the spanner slot 335*a* is also shown in FIG. 2), which spanner slots 335*a* and 335*b* are adapted to be engaged by a spanner wrench to facilitate assembly of the of the actuating tool 150. The auxiliary sleeve 190 includes an internal threaded connection 340 at an end portion thereof opposite the plug 160 (shown in FIGS. 2 and 3A). The internal threaded connection 340 of the auxiliary sleeve 190 threadably engages the external threaded connection 325 of the housing retainer 185 to thereby connect the auxiliary sleeve 190 to the housing retainer 185. In one or more embodiments, the internal threaded connection 340 of the auxiliary sleeve 190 is threaded onto the external threaded connection 325 of the housing retainer 185 until the end portion of the auxiliary sleeve 190 opposite the plug 160 engages the collar 330 of the housing retainer 185.

An internal passage 345 is formed into the housing retainer 185 at the end portion 305*b*, which internal passage 345 only extends partially through the housing retainer 185. The internal passage 345 is in fluid communication with the internal passage 230 of the auxiliary sleeve 190. A projection 350 extends from the end portion 305*a* of the housing retainer 185, which projection 350 forms part of the housing retainer 185. The projection 350 has a diameter smaller than that of the housing retainer 185 at the end portion 305*a*. An external shoulder 355 is formed at the end portion 305*a* of the housing retainer 185 between the projection 350 and the external threaded connection 315. An internal passage 360 extends through the housing retainer 185, including the projection 350, from the sub-chamber 225*b* into the internal passage 345. The internal passage 345 has a diameter larger than that of the internal passage 360. The internal passage 345 defines an internal shoulder 365 in the housing retainer 185, adjacent the internal passage 360. The internal passage 360 accommodates the piston rod 210*b* extending from the piston head 210*a*. Internal annular grooves 370*a* and 370*b* are formed into housing retainer 185 at the internal passage 360, which internal annular grooves 370*a* and 370*b* are each adapted to accommodate a sealing element enabling the housing retainer 185 to sealingly and slidably engage the piston rod 210*b*. An opening 375 is formed through the housing retainer 185, including at least a portion of the projection 350 (as more clearly shown in FIG. 3C), from the sub-chamber 225*b* into the internal passage 345. The seal assembly 235 extends within the opening 375 and sealingly engages the housing retainer 185.

Figure 3C:
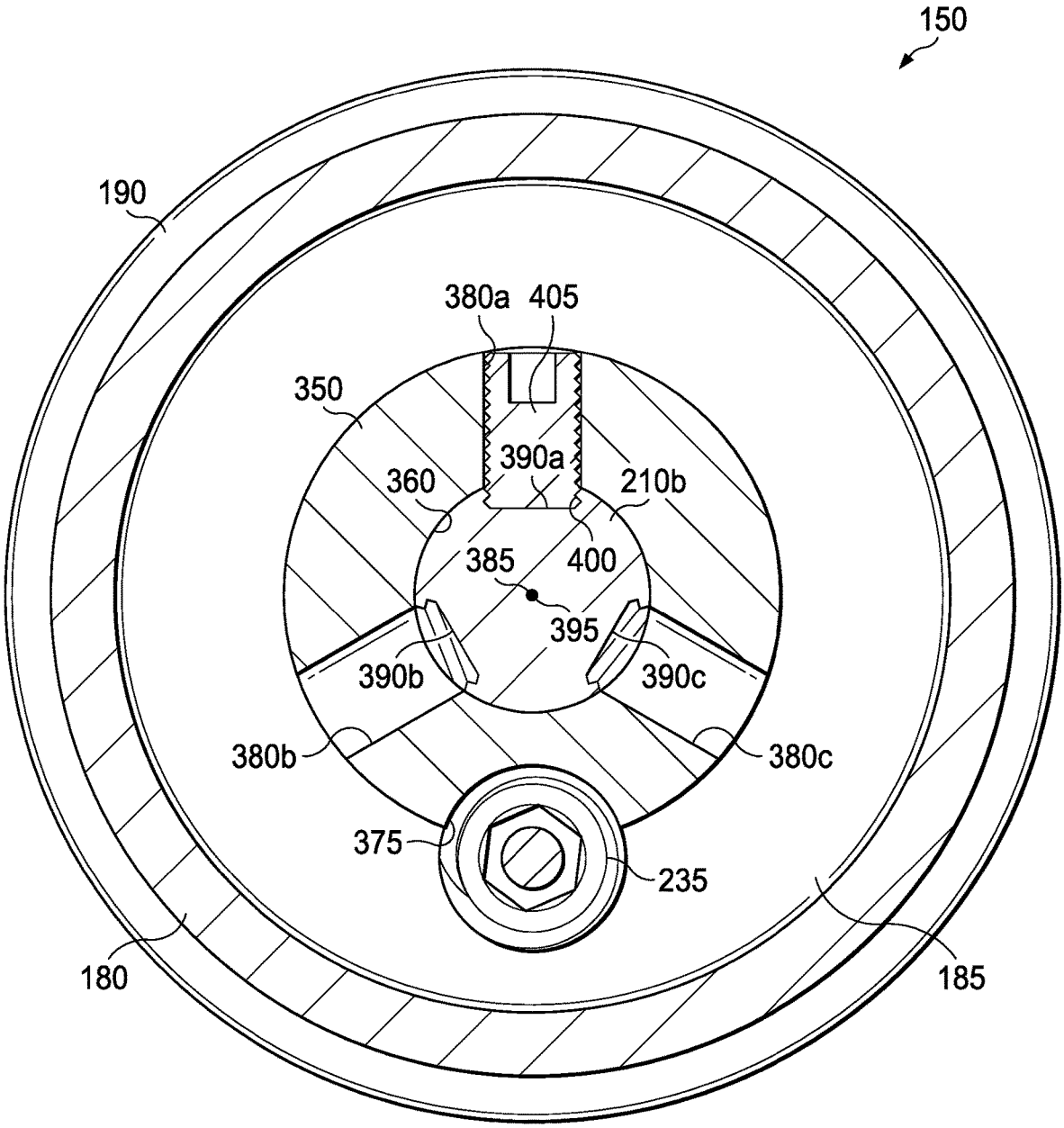
FIG. 3C is a cross-sectional view of the actuating tool of FIG. 3B taken along the line 3C-3C in FIG. 3B, according to one or more embodiments.

FIG. 3C is a cross-sectional view of the actuating tool 150 taken along the line 3C-3C of FIG. 3B, according to one or more embodiments. Referring to FIG. 3C, with continuing reference to FIG. 3B, in an embodiment, radial openings 380*a-c* are formed through the projection 350 of the housing retainer 185 and into the internal passage 360. The radial openings 380*a-c* are distributed (e.g., evenly) about a longitudinal center axis 385 of the housing retainer 185. Likewise, blind holes 390*a-c* are formed radially into the piston rod 210*b*, each of which blind holes 390*a-c* only extends partially through the piston rod 210*b*. The blind holes 390*a-c* are distributed (e.g., evenly) about a longitudinal center axis 395 of the piston rod 210*b*. An internal threaded connection 400 is formed in the piston rod 210*b* at each of the blind holes 390*a-c*. The longitudinal center axes 385 and 395 are coaxial. The blind holes 390*a-c* correspond to, and are aligned with, the radial openings 380*a-c*. A shear pin 405 extends within both the radial opening 380*a* and the blind hole 390*a*. The shear pin 405 threadably engages the internal threaded connection 400 formed in the piston rod 210*b* at the blind holes 390*a*. As a result, the shear pin 405 restricts relative movement between the piston rod 210*b* and the housing retainer 185 until a threshold force is applied to the piston rod 210*b*, as will be described in further detail below. Although shown with only the shear pin 405 extending within both the radial opening 380*a* and the blind hole 390*a*, in addition, or instead, additional shear pin(s) identical to the shear pin 405 may also extend within the radial opening 380*b* and the blind hole 390*b*, the radial opening 380*c* and the blind hole 390*c*, or both.

FIG. 3D is an enlarged view illustrating a sub-portion of the portion of the actuating tool 150 shown in FIG. 3B, according to one or more embodiments. Referring to FIG. 3D, in an embodiment, the opening 270 formed through the piston head 210*a* between the sub-chambers 225*a* and 225*b* includes opposing end portions 410*a* and 410*b*. The end portions 410*a* and 410*b* of the opening 270 extend adjacent the sub-chambers 225*a* and 225*b*, respectively. The end portion 410*b* of the opening 270 has a diameter larger than that of the end portion 410*a*. The end portion 410*b* of the opening 270 defines an internal shoulder 415 in the piston head 210*a*, adjacent the end portion 410*a*. An internal threaded connection 416 is formed in the piston head 210*a* at the end portion 410*b* of the opening 270, adjacent the sub-chamber 225*b*. The conductive fitting 240 extending within the opening 270 and sealingly engaging the piston head 210*a* includes a housing 420 and an electrical conductor 425.

The housing 420 includes opposing end portions 430*a* and 430*b*. The end portion 430*a* of the conductor housing 420 has a diameter smaller than that of the end portion 430*b*. An external shoulder 435 is formed in the conductor housing 420 between the end portions 430*a* and 430*b*. The external shoulder 435 of the conductor housing 420 engages the internal shoulder 415 in the piston head 210*a*. External annular grooves 440*a* and 440*b* are formed into the conductor housing 420 at the end portion 430*b*, which external annular grooves 440*a* and 440*b* are each adapted to accommodate a sealing element enabling the conductor housing 420 of the conductive fitting 240 to sealingly engage the piston head 210*a*. An external threaded connection 445 is formed in the conductor housing 420 at the end portion 430*b*, adjacent the sub-chamber 225*b*. The external threaded connection 445 formed in the conductor housing 420 threadably engages the internal threaded connection 416 formed in the piston head 210*a* to thereby connect the conductor housing 420 to the piston head 210*a*. An opening 450 is formed through the conductor housing 420 between the sub-chambers 225*a* and 225*b*, which opening 450 includes opposing end portions 455*a* and 455*b*. The end portions 455*a* and 455*b* of the opening 450 extend adjacent the sub-chambers 225*a* and 225*b*, respectively. The end portion 455*b* of the opening 450 has a diameter larger than that of the end portion 455*a*. The end portion 455*b* of the opening 450 defines an internal shoulder 460 in the piston head 210*a*, adjacent the end portion 455*a*. An internal threaded connection 465 is formed in the conductor housing 420 at the end portion 455*b* of the opening 450.

The electrical conductor 425 defines opposing end portions 470*a* and 470*b*. A blind hole 475 is formed in the end portion 470*a* of the electrical conductor 425, which blind hole 475 only extends partially through the electrical conductor 425. An external threaded connection 480 is formed in the electrical conductor 425 proximate the end portion 470*a*. The external threaded connection 480 of the electrical conductor 425 threadably engages the internal threaded connection 465 of conductor housing 420 to thereby connect the electrical conductor 425 to the conductor housing 420. The electrical conductor 245*b* (e.g., the wire) connects the conductor sub (not shown) to the end portion 470*a* of the electrical conductor 425 at the blind hole 475. Likewise, a blind hole 485 is formed in the end portion 470*b* of the electrical conductor 425, which blind hole 485 only extends partially through the electrical conductor 425. External annular grooves 490*a* and 490*b* are formed in the electrical conductor 425 at the end portion 470*b*, which external annular grooves 490*a* and 490*b* are each adapted to accommodate a sealing element enabling the electrical conductor 425 to sealingly engage the conductor housing 420. The electrical conductor 245*a* (e.g., the wire) connects the seal assembly 235 to the end portion 470*b* of the electrical conductor 425 at the blind hole 485.

The opening 375 formed through the housing retainer 185, including the at least a portion of the projection 350 (as more clearly shown in FIG. 3C), from the sub-chamber 225*b* into the internal passage 345, includes opposing end portions 495*a* and 495*b* and an intermediate portion 495*c*. The end portions 495*a* and 495*b* of the opening 375 extend adjacent the sub-chamber 225*b* and the internal passage 345, respectively. The end portion 495*a* of the opening 375 has a diameter larger than that of the intermediate portion 495*c*. The end portion 495*a* of the opening 375 defines an internal shoulder 500 in the housing retainer 185, adjacent the intermediate portion 495*c*. An internal frusto-conical surface 505 is formed in the housing retainer 185 at the intermediate portion 495*c* of the opening 375, adjacent the internal shoulder 500. An internal threaded connection 510 is formed in the housing retainer 185 at the end portion 495*a* of the opening 375, adjacent the sub-chamber 225*b*. The intermediate portion 495*c* of the opening 375 has a diameter larger than that of the end portion 495*b*. The intermediate diameter portion 495*c* defines an internal shoulder 512 in the housing retainer 185, adjacent the end portion 495*b*. The seal assembly 235 includes a seal plug 515, a heating element 520, a load ring 525, and a seal retainer 530. The seal plug 515 defines opposing end portions 535*a* and 535*b*. The end portion 535*b* of the seal plug 515 engages the internal shoulder 512 of the housing retainer 185 and has a diameter smaller than that of the end portion 535*a*. An external frusto-conical surface 540 is formed in the seal plug 515 between the end portions 535*a* and 535*b*, which external frusto-conical surface 540 engages the internal frusto-conical surface 505 formed in the housing retainer 185. The end portion 535*b* of the seal plug 515 extends within the end portion 495*b* of the opening 375. External annular grooves 545*a* and 545*b* are formed in the end portion 535*b* of the seal plug 515, which external annular grooves 545*a* and 545*b* are each adapted to accommodate a sealing element to enable the seal plug 515 to sealingly engage the housing retainer 185 at the end portion 495*b* of the opening 375. A blind hole 550 is formed in the end portion 535*a* of the seal plug 515, which blind hole 550 only extends partially through the seal plug 515. The blind hole 550 accommodates the heating element 520. In one or more embodiments, the seal plug 515 and the heating element 520 are integrally formed as a unitary component.

The load ring 525 defines opposing end portions 555*a* and 555*b*. An internal passage 560 extends through the load ring 525 from the end portion 555*a* to the end portion 555*b*. The internal passage 560 accommodates the heating element 520. The end portion 555*b* of the load ring 525 engages the end portion 535*a* of the seal plug 515. The seal retainer 530 defines opposing end portions 565*a* and 565*b*. The end portion 565*b* of the seal retainer 530 engages the end portion 555*a* of the load ring 525. An external threaded connection 570 is formed in the seal retainer 530. The external threaded connection 570 of the seal retainer 530 threadably engages the internal threaded connection 510 of the housing retainer 185. An internal passage 575 extends through the seal retainer 530. A tool receptacle 580 is formed in the seal retainer 530 at the internal passage 575. Moreover, the internal passage 575 of the seal retainer 530 accommodates the heating element 520. The tool receptacle 580 is adapted to receive a tool, which tool is utilized to threadably tighten the external threaded connection 570 of the seal retainer 530 into the internal threaded connection 510 of the housing retainer 185. When so threadably tightened, the seal retainer 530 squeezes the load ring 525 against the seal plug 515 to hold the end portion 535*b* of the seal plug 515, including the external annular grooves 545*a* and 545*b* each accommodating a sealing element, within the end portion 495*b* of the opening 375. As a result, the seal plug 515 sealingly engages the housing retainer 185 at the end portion 495*b* of the opening 375, thereby preventing, or at least reducing, fluid communication between the internal passage 345 of the housing retainer 185 and the sub-chamber 225*b*. The electrical conductor 245*a* (e.g., the wire) connects the heating element 520 of the seal assembly 235 to the end portion 470*b* of the electrical conductor 425 at the blind hole 485.

Figure 4A:
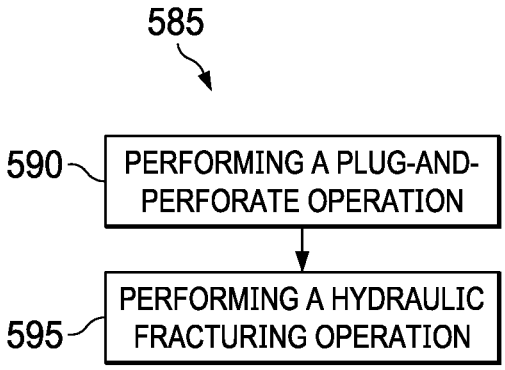
FIG. 4A is a flow diagram of a method for implementing one or more embodiments of the present disclosure.
Figure 4B:
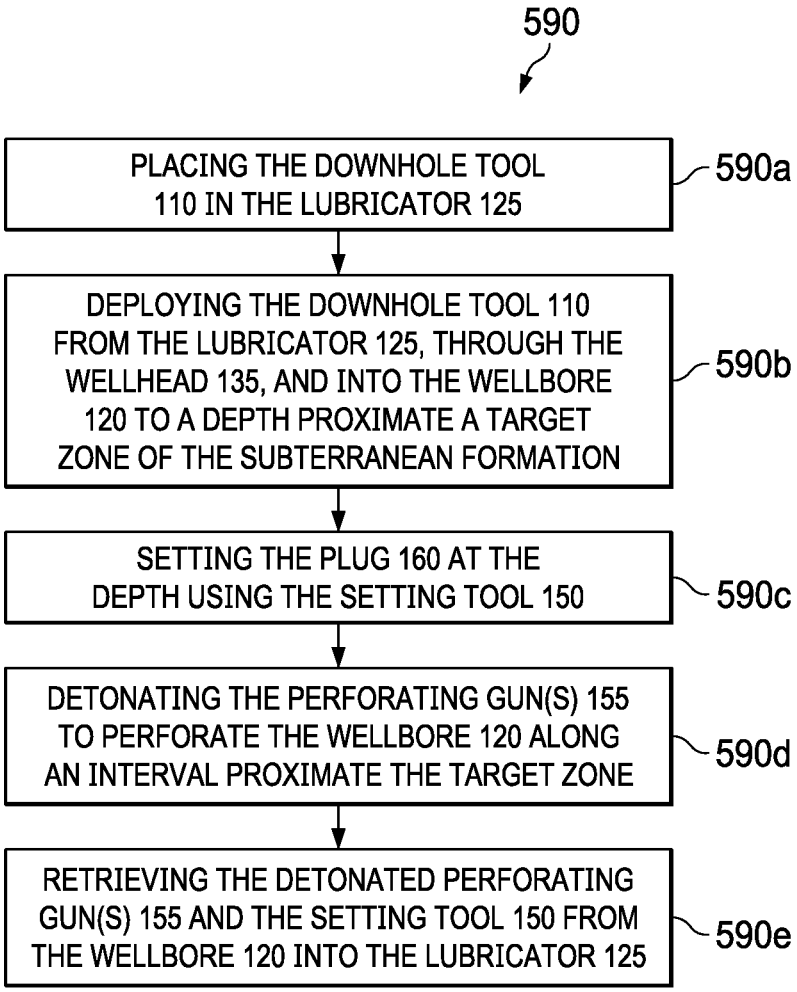
FIG. 4B is a flow diagram of a first step of the method of FIG. 4A, said first step including a plurality of sub-steps, according to one or more embodiments.
Figure 4C:
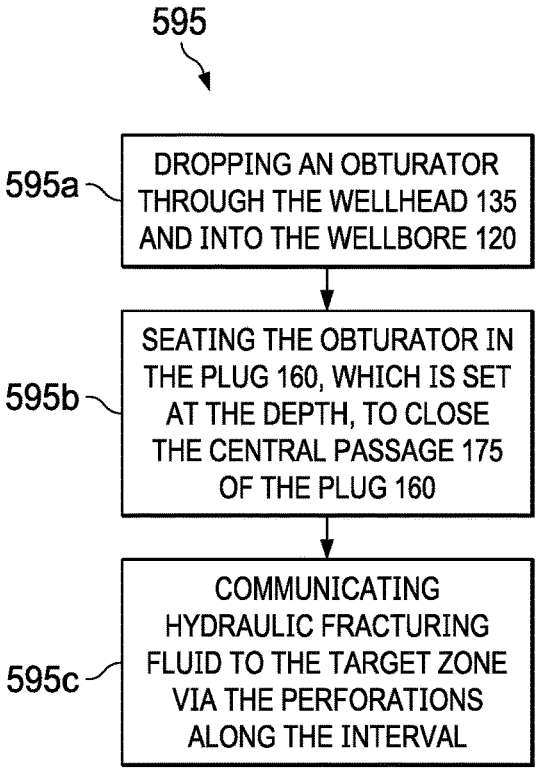
FIG. 4C is a flow diagram of a second step of the method of FIG. 4A, said second step including a plurality of sub-steps, according to one or more embodiments.
Figure 5:
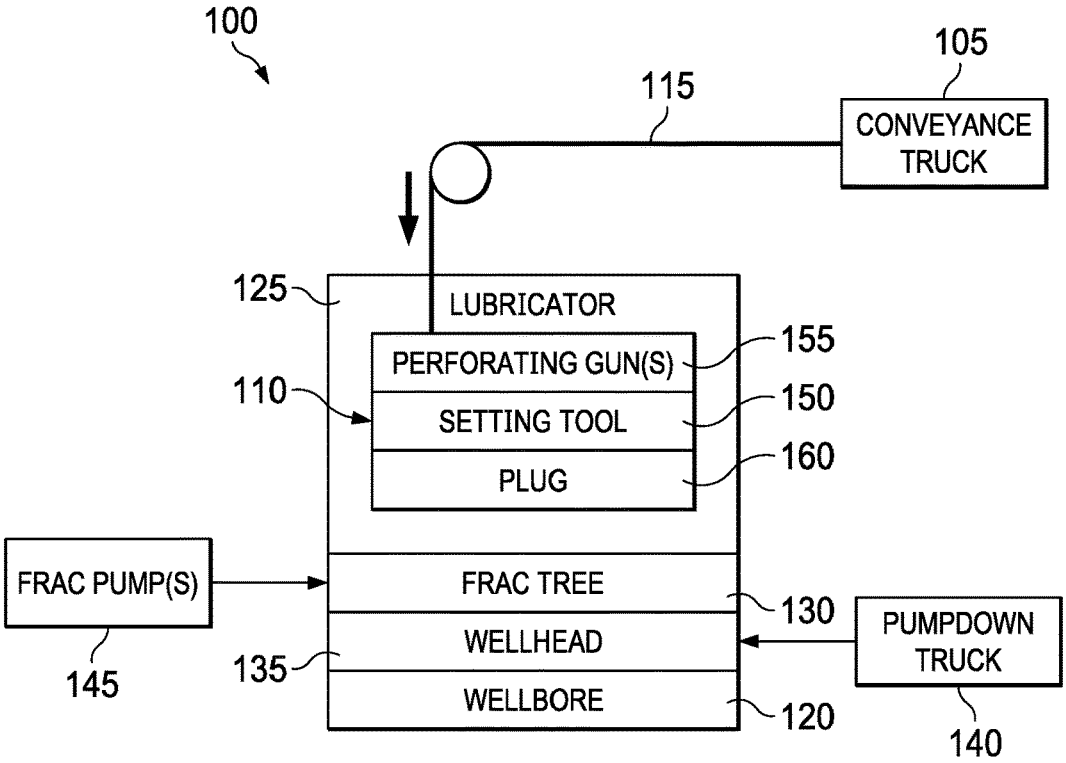
FIG. 5 is a diagrammatic illustration of the system of FIG. 1 in a first operational state or configuration during execution of the first step shown in FIG. 4B, according to one or more embodiments.
Figure 6:
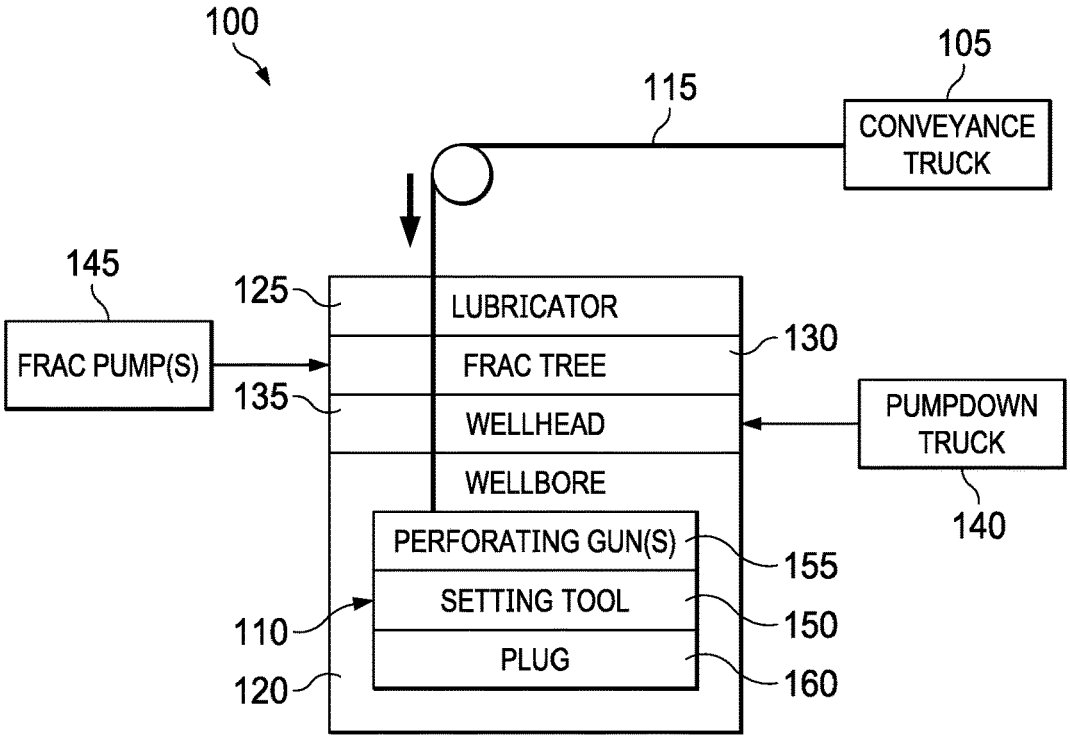
FIG. 6 is a diagrammatic illustration of the system of FIG. 1 in a second operational state or configuration during execution of the first step shown in FIG. 4B, according to one or more embodiments.
Figure 7:
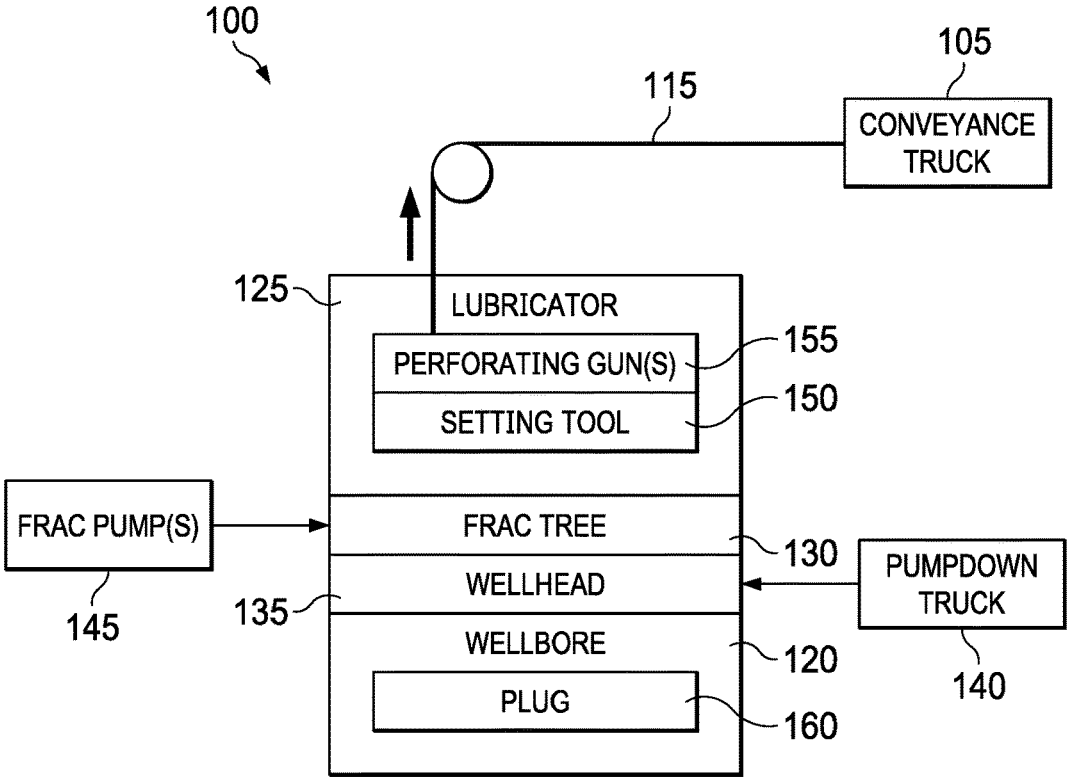
FIG. 7 is a diagrammatic illustration of the system of FIG. 1 in a third operational state or configuration during execution of the first step shown in FIG. 4B, according to one or more embodiments.

FIGS. 4A-4C are flow diagrams of a method for utilizing the system 100 to hydraulically fracturing a zone of the wellbore 120, according to one or more embodiments. Referring to FIG. 4A, in an embodiment, the method is generally referred to by the reference numeral 585 and includes, at a step 590, performing a plug-and-perforate operation and, at a step 595, performing a fracturing operation. Turning to FIG. 4B, the step 590 of performing the plug-and-perforate operation includes, at a sub-step 590*a*, placing the downhole tool 110 in the lubricator 125, as shown in FIG. 5. More particularly, FIG. 5 is a diagrammatic illustration of the system 100 of FIG. 1 in an operational state or configuration caused by execution of the sub-step 590*a*, that is, after the downhole tool 110 has been placed in the lubricator 125. Turning back to FIG. 4B, the step 590 of the method 585 further includes, at a sub-step 590*b*, deploying the downhole tool 110 from the lubricator 125, through the wellhead 135, and into the wellbore 120 to a depth proximate a target zone of the subterranean formation, as shown in FIG. 6. More particularly, FIG. 6 is a diagrammatic illustration of the system of FIG. 1 in an operational state or configuration caused by execution of the sub-step 590*b*, that is, after the downhole tool 110 has been deployed from the lubricator 125, through the wellhead 135, and into the wellbore 120 to the depth. Turning back to FIG. 4B, the step 590 further includes, at a sub-step 590*c*, setting the plug 160 at the depth using the actuating tool 150. The step 590 further includes, at a sub-step 590*d*, detonating the perforating gun(s) 155 to perforate the wellbore 120 along an interval proximate the target zone. Finally, the step 590 includes, at a sub-step 590*e*, retrieving the detonated perforating gun(s) 155 and the actuating tool 150 from the wellbore 120 into the lubricator 125, as shown in FIG. 7. More particularly, FIG. 7 is a diagrammatic illustration of the system of FIG. 1 in an operational state or configuration caused by execution of the sub-step 590*e*, that is, after the detonated perforating gun(s) 155 and the actuating tool 150 have been retrieved from the wellbore 120 into the lubricator 125. The step 590*e* of retrieving the detonated perforating gun(s) 155 and the actuating tool 150 from the wellbore 120 includes detaching the plug adapter 205 from the plug 160 by shearing or otherwise disengaging the fasteners 194 and/or disengaging the detents, protrusions, slots, ridges, grooves, ridges, the like, or a combination thereof, used to detachably connect the plug 160 to the plug adapter 205.

Turning to FIG. 4C, the step 595 of performing the fracturing operation includes, at a sub-step 595*a*, dropping an obturator through the wellhead 135 and into the wellbore 120. The step 595 further includes, at a sub-step 595*b*, seating the obturator in the plug 160, which is set at the depth, to close the central passage 175 of the plug 160. Finally, the step 595 includes, at a sub-step 595*c*, communicating hydraulic fracturing fluid to the target zone via the perforations along the interval. More particularly, the sub-step 595*c* includes pumping the fracturing fluid to the frac tree 130 using the frac pump(s) 145 so that the fracturing fluid flows through the frac tree 130, through the wellhead 135, into the wellbore 120, through the perforations along the interval, and into the target zone of the subterranean formation.

Figure 8:
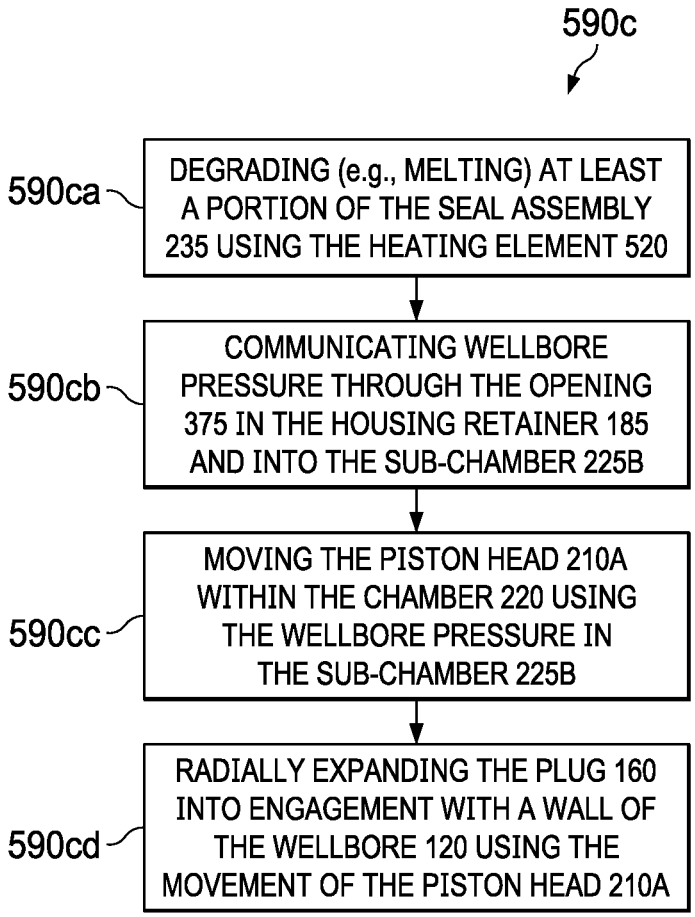
FIG. 8 is a flow diagram of a sub-step of the first step shown in FIG. 4B, said sub-step including a plurality of sub-steps, according to one or more embodiments.

FIG. 8 is a flow diagram of the sub-step 590*c* of the step 590 of the method 585, according to one or more embodiments. Referring to FIG. 8, in an embodiment, the sub-step 590*c* of setting the plug 160 at the depth using the actuating tool 150 includes, at a sub-step 590*ca*, degrading (e.g., melting) at least a portion of the seal assembly 235 using the heating element 520. The sub-step 590*ca* of degrading (e.g., melting) the at least a portion of the seal assembly 235 using the heating element 520 includes degrading the seal plug 515, the load ring 525, the sealing elements accommodated within the external annular grooves 545*a* and 545*b* of the seal plug 515, or a combination thereof, using the heating element 520. In one or more embodiments, the heating element 520 is a heating coil. For example, the heating element 520 may be or include a resistance wire such as, for example, nichrome wire. In one or more embodiments, the heating element 520 is an inductive heating element. The heating element 520 may be activated by communicating electricity to the heating element 520 via the electrical conductor 245*a*, the electrical conductor 425 of the conductive fitting 240 (shown in FIGS. 3B and 3D), the electrical conductor 245*b*, and the conductor sub (not shown). In addition, or instead, the heating element 520 may be activated by battery power. In addition, or instead, the heating element 520 may be activated by power that is initiated via a remote signal from the surface and/or another location in or near the downhole tool 110 (e.g., via a transmitter/receiver pair in the downhole tool 110 and the heating element 520, respectively). For example, the downhole tool 110 may include an addressable switch associated with the heating element 520 and operable as a 2-way communication device to arm and activate the heating element 520.

Figure 9A:
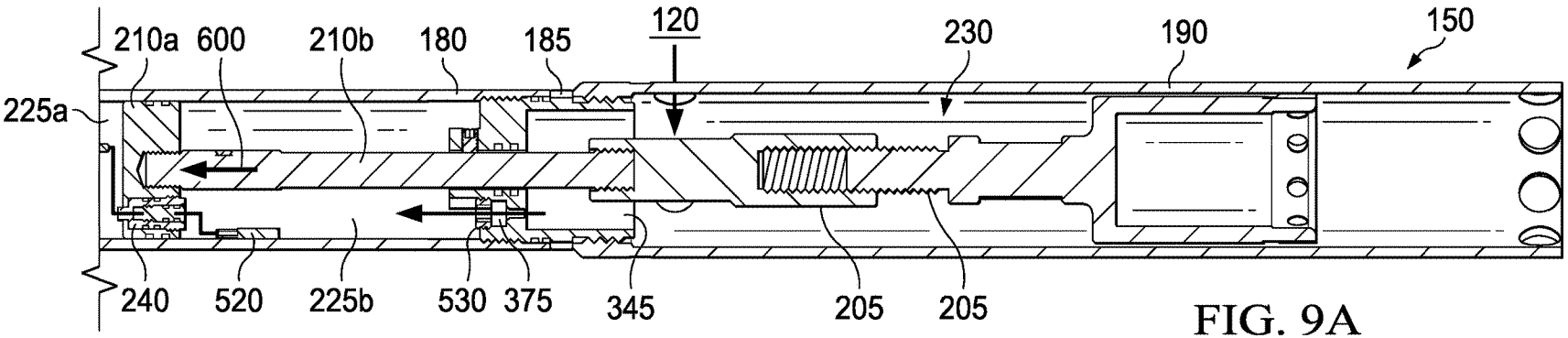
FIG. 9A is a cross-sectional view of the actuating tool of FIG. 3A during execution of the sub-step shown in FIG. 8, according to one or more embodiments.
Figure 9B:
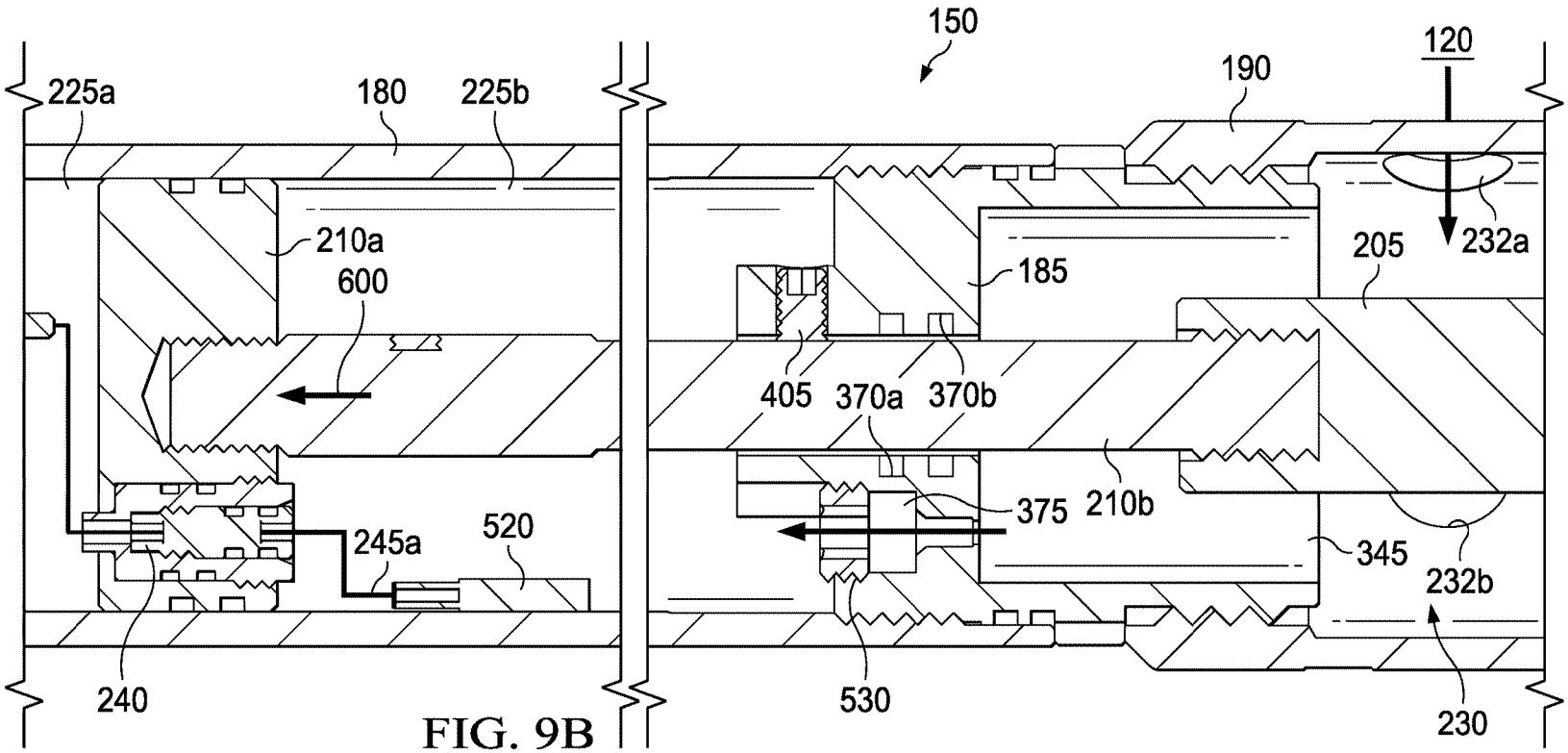
FIG. 9B is an enlarged view of the cross-sectional view of the actuating tool shown in FIG. 9A, according to one or more embodiments.

The sub-step 590*c* further includes, at a sub-step 590*cb*, communicating wellbore pressure through the opening 375 in the housing retainer 185 and into the sub-chamber 225*b*, as shown in FIGS. 9A and 9B. More particularly, FIG. 9A is a cross-sectional view of the actuating tool 150 similar to the view shown in FIG. 3A, except that the seal assembly 235 has been degraded to allow wellbore pressure to be communicated from the internal passage 345 of the housing retainer 185, which internal passage 345 communicates with the wellbore 120 via the internal passage 230 and the radial openings 232*a-c* of the auxiliary sleeve 190, to the sub-chamber 225*b* via the opening 375, according to one or more embodiments. Furthermore, FIG. 9B is an enlarged view of a portion of the actuating tool 150 shown in FIG. 9A (similar to the view shown in FIG. 3B), according to one or more embodiments.

The sub-step 590*c* further includes, at a sub-step 590*cc*, moving the piston head 210*a* within the chamber 220 using the wellbore pressure in the sub-chamber 225*b*, as shown in FIGS. 9A and 9B. Prior to degradation of the seal assembly 235 at the sub-step 590*ca*, the chamber 220, including the sub-chambers 225*a* and 225*b*, contains atmospheric pressure (or some other pressure lower than wellbore pressure at the depth adjacent the target zone of the subterranean formation). As a result, when the seal assembly 235 is degraded at the sub-step 590*ca*, causing the wellbore pressure to be communicated to the sub-chamber 225*b* at the sub-step 590*cb*, the wellbore pressure in the sub-chamber 225*b* exceeds the pressure (e.g., atmospheric pressure) in the sub-chamber 225*a*. Due to the pressure in the sub-chamber 225*b* exceeding the pressure in the sub-chamber 225*a*, a force is exerted on the piston head 210*a* in a direction 600 away from the housing retainer 185 and towards the conductor sub (not shown). When the force exerted on the piston head 210*a* exceeds the threshold force required to shear the shear pin 405 (and/or the additional shear pin(s)), the shear pin 405 (and/or the additional shear pin(s)) is sheared and the piston head 210*a* moves in the direction 600, as shown in FIGS. 9A and 9B.

Finally, the sub-step 590*c* includes, at a sub-step 590*cd*, radially expanding the plug 160 into engagement with a wall of the wellbore 120 using the movement of the piston head 210*a*. Moving the piston head 210*a* within the chamber 220 using the wellbore pressure at the sub-step 590*cc* also causes the piston rod 210*b* and the plug adapter 205 to move in the direction 600. The sealing elements accommodated within the internal annular grooves 370*a* and 370*b* of the housing retainer 185 sealingly and slidably engage the piston rod 210*b* as the piston rod 210*b* moves in the direction 600. The plug adapter 205 is connected to the plug 160 and, as a result, the movement of the plug adapter 205 actuates the plug 160, causing the packer element 165 (shown in FIG. 2) to radially expand into sealing engagement with the wall of the wellbore 120, and causing the slip elements 170 (shown in FIG. 2) to radially expand into anchoring engagement with the wall of the wellbore 120 (e.g., a casing string cemented in the wellbore 120, an open hole section of the wellbore, the like, or a combination thereof).

Although described herein as including the seal plug 515, the load ring 525, the seal retainer 530, and the heating element 520, in addition, or instead, the seal assembly 235 may be or include another type of seal assembly such as, for example, a chemically-degradable seal assembly, a mechanically-actuable and/or mechanically-degradable seal assembly, a hydraulically-actuable and/or hydraulically-degradable seal assembly, the like, or a combination thereof. In such embodiments, the step 590*ca* of degrading the at least a portion of the seal assembly 235 using the heating element 520 is correspondingly altered or replaced with a step of chemically degrading at least a portion of the chemically-degradable seal assembly using a wellbore fluid (or another fluid), a step of mechanically actuating and/or mechanically degrading the mechanically-actuable and/or mechanically-degradable seal assembly, a step of hydraulically actuating and/or hydraulically degrading the hydraulically-actuable and/or hydraulically-degradable seal assembly, the like, or a combination thereof.

In one or more embodiments, the use of the actuating tool 150 and/or the execution of the method 585 eliminates the need for explosive or other energetic devices to actuate the plug 160, permitting a slower, smoother, and steadier actuation of the plug 160 due to the constant wellbore pressure applied to the piston head 210*a*. Further, the use of the actuating tool 150 and/or the execution of the method 585 eliminates, or at least decreases, the amount of shock usually associated with the actuation of plugs by detonation of energetic devices, thereby more reliably setting the plug 160 in the wellbore 120. Further still, the use of the actuating tool 150 and/or the execution of the method 585 decreases the costs usually associated with the actuation of plugs by detonation of energetic devices by, for example, eliminating consumables and improving reusability.

In one or more embodiments, the actuating tool 150 is manufactured in accordance with the foregoing description, and/or one or more of FIGS. 1-9B.

In one or more embodiments, the actuating tool 150 is produced in accordance with one or more methods, the one or more methods being described above and/or illustrated in FIGS. 1-9B.

In one or more embodiments, the actuating tool 150 is redressed. In one or more embodiments, the actuating tool 150 is redressed after use and/or the execution of the method 585. In one or more embodiments, after the actuating tool 150 has been redressed, the redressed actuating tool 150 is operated in accordance with the foregoing description, and/or the method 585 is executed using the redressed actuating tool 150. In one or more embodiments, redressing the actuating tool 150 after each use, and/or after each execution of the method 585, allows the actuating tool 150 to be used repeatedly. In one or more embodiments, to redress the actuating tool 150, a redress kit is provided, and component(s) of the redress kit is/are installed in the actuating tool 150 in accordance with the foregoing description and/or FIGS. 1-9B; in several embodiments, the redress kit includes a seal assembly that is identical to the seal assembly 235; in several embodiments, the redress kit includes a seal plug that is identical to the seal plug 515, and/or a heating element that is identical to the heating element 520; in several embodiments, the redress kit includes a seal plug that is identical to the seal plug 515, a heating element that is identical to the heating element 520, a load ring that is identical to the load ring 525, a seal retainer that is identical to the seal retainer 530, or any combination thereof.

In several embodiments, the actuating tool 150 or a portion thereof is provided as a kit, which may be assembled. In several embodiments, a portion of the actuating tool 150 is provided as a kit, and the portion is assembled using the components of kit and/or is installed in the remainder of the actuating tool 150.

A downhole tool has been disclosed, which downhole tool is adapted to be positioned into a wellbore. The downhole tool generally includes: an actuating tool, including: a main housing; a housing retainer connected to the main housing so that, in combination, the main housing and the housing retainer at least partially define a chamber; a piston extending through the housing retainer and dividing the chamber into first and second sub-chambers; an auxiliary sleeve connected to the housing retainer, opposite the main housing; and a seal assembly; and an auxiliary tool connected to the auxiliary sleeve, opposite the housing retainer; wherein the actuating tool is actuable to: a first configuration, in which: the seal assembly is sealingly disengaged from the housing retainer to permit fluid communication, via a first opening in the housing retainer, between the first sub-chamber and the wellbore; the fluid communication between the first sub-chamber and the wellbore moves the piston to a first axial position relative to the housing retainer; and the movement of the piston to the first axial position actuates the auxiliary tool to a first state. In one or more embodiments, the fluid communication between the first sub-chamber and the wellbore is further permitted via a second opening in the auxiliary sleeve. In one or more embodiments, the actuating tool is further actuable: from a second configuration, in which: the seal assembly sealingly engages the housing retainer to fluidically isolate the first sub-chamber from the wellbore; the piston is situated in a second axial position relative to the housing retainer; and the auxiliary tool is in a second state; to the first configuration. In one or more embodiments, the seal assembly includes: a heating element; and the heating element is adapted to degrade at least a portion of the seal assembly to sealingly disengage the seal assembly from the housing retainer, thereby actuating the actuating tool from the second configuration to the first configuration. In one or more embodiments, the piston includes: a piston head dividing the chamber into the first and second sub-chambers; and a piston rod connected to the piston head and extending through the housing retainer. In one or more embodiments, the actuating tool further includes: a conductive fitting extending through the piston head and between the first and second sub-chambers; and a first electrical conductor connecting the conductive fitting to the seal assembly; and the first electrical conductor is adapted to communicate electricity from the conductive fitting to the seal assembly to sealingly disengage the seal assembly from the housing retainer, thereby actuating the actuating tool from the second configuration to the first configuration. In one or more embodiments, the actuating tool further includes: a conductor sub connected to the main housing, opposite the housing retainer, so that, in combination, the main housing, the housing retainer, and the conductor sub define the chamber; and a second electrical conductor connecting the conductor sub to the conductive fitting; and the second electrical conductor is adapted to communicate electricity from the conductor sub to the conductive fitting. In one or more embodiments, the auxiliary tool includes a plug, which plug includes: a packer element; and a plurality of slip elements.

A first method has also been disclosed. The first method generally includes: positioning a downhole tool into a wellbore, the downhole tool including: an actuating tool, including: a main housing; a housing retainer connected to the main housing so that, in combination, the main housing and the housing retainer at least partially define a chamber; a piston extending through the housing retainer and dividing the chamber into first and second sub-chambers; an auxiliary sleeve connected to the housing retainer, opposite the main housing; and a seal assembly; and an auxiliary tool connected to the auxiliary sleeve, opposite the housing retainer; and actuating the actuating tool: to a first configuration, in which: the seal assembly is sealingly disengaged from the housing retainer to permit fluid communication, via a first opening in the housing retainer, between the first sub-chamber and the wellbore; the fluid communication between the first sub-chamber and the wellbore moves the piston to a first axial position relative to the housing retainer; and the movement of the piston to the first axial position actuates the auxiliary tool to a first state. In one or more embodiments, the fluid communication between the first sub-chamber and the wellbore is further permitted via a second opening in the auxiliary sleeve. In one or more embodiments, the method further includes: actuating the actuating tool: from a second configuration, in which: the seal assembly sealingly engages the housing retainer to fluidically isolate the first sub-chamber from the wellbore; the piston is situated in a second axial position relative to the housing retainer; and the auxiliary tool is in a second state; to the first configuration. In one or more embodiments, the seal assembly includes: a heating element; and actuating the actuating tool from the second configuration to the first configuration includes degrading, using the heating element, at least a portion of the seal assembly to sealingly disengage the seal assembly from the housing retainer. In one or more embodiments, the piston includes: a piston head dividing the chamber into the first and second sub-chambers; and a piston rod connected to the piston head and extending through the housing retainer. In one or more embodiments, the actuating tool further includes: a conductive fitting extending through the piston head and between the first and second sub-chambers; and a first electrical conductor connecting the conductive fitting to the seal assembly; and actuating the actuating tool from the second configuration to the first configuration includes communicating electricity, via the first electrical conductor, from the conductive fitting to the seal assembly to sealingly disengage the seal assembly from the housing retainer. In one or more embodiments, the actuating tool further includes: a conductor sub connected to the main housing, opposite the housing retainer, so that, in combination, the main housing, the housing retainer, and the conductor sub define the chamber; and a second electrical conductor connecting the conductor sub to the conductive fitting; and actuating the actuating tool from the second configuration to the first configuration further includes communicating electricity, via the second electrical conductor, from the conductor sub to the conductive fitting. In one or more embodiments, the auxiliary tool includes a plug, which plug includes: a packer element; and a plurality of slip elements.

An actuating tool has also been disclosed, which actuating tool is adapted to be positioned into a wellbore. The actuating tool generally includes: a main housing at least partially defining a chamber; a piston dividing the chamber into first and second sub-chambers; and a seal assembly; wherein the actuating tool is actuable to: a first configuration, in which: the seal assembly is sealingly disengaged to permit fluid communication, via a first opening, between the first sub-chamber and the wellbore; and the fluid communication between the first sub-chamber and the wellbore moves the piston to a first axial position relative to the main housing. In one or more embodiments, the actuating tool further includes: a housing retainer connected to the main housing so that, in combination, the main housing and the housing retainer at least partially define the chamber; wherein the first opening is formed in the housing retainer. In one or more embodiments, the actuating tool further includes: an auxiliary sleeve connected to the housing retainer, opposite the main housing; and the fluid communication between the first sub-chamber and the wellbore is further permitted via a second opening in the auxiliary sleeve. In one or more embodiments, the actuating tool is further actuable: from a second configuration, in which: the seal assembly is sealingly engaged to fluidically isolate the first sub-chamber from the wellbore; and the piston is situated in a second axial position relative to the main housing; to the first configuration. In one or more embodiments, the seal assembly includes: a heating element; and the heating element is adapted to degrade at least a portion of the seal assembly to sealingly disengage the seal assembly, thereby actuating the actuating tool from the second configuration to the first configuration. In one or more embodiments, the piston includes: a piston head dividing the chamber into the first and second sub-chambers; and a piston rod connected to the piston head. In one or more embodiments, the actuating tool further includes: a conductive fitting extending through the piston head and between the first and second sub-chambers; and a first electrical conductor connecting the conductive fitting to the seal assembly; and the first electrical conductor is adapted to communicate electricity from the conductive fitting to the seal assembly to sealingly disengage the seal assembly, thereby actuating the actuating tool from the second configuration to the first configuration. In one or more embodiments, the actuating tool further includes: a conductor sub connected to the main housing so that, in combination, the main housing and the conductor sub at least partially define the chamber; and a second electrical conductor connecting the conductor sub to the conductive fitting; and the second electrical conductor is adapted to communicate electricity from the conductor sub to the conductive fitting.

A second method has also been disclosed. The second method generally includes: positioning an actuating tool into a wellbore, the actuating tool including: a main housing at least partially defining a chamber; a piston dividing the chamber into first and second sub-chambers; and a seal assembly; and actuating the actuating tool: to a first configuration, in which: the seal assembly is sealingly disengaged to permit fluid communication, via a first opening, between the first sub-chamber and the wellbore; and the fluid communication between the first sub-chamber and the wellbore moves the piston to a first axial position relative to the main housing. In one or more embodiments, the actuating tool further includes: a housing retainer connected to the main housing so that, in combination, the main housing and the housing retainer at least partially define the chamber; and the first opening is formed in the housing retainer. In one or more embodiments, the actuating tool further includes: an auxiliary sleeve connected to the housing retainer, opposite the main housing; and the fluid communication between the first sub-chamber and the wellbore is further permitted via a second opening in the auxiliary sleeve. In one or more embodiments, the method further includes: actuating the actuating tool: from a second configuration, in which: the seal assembly is sealingly engaged to fluidically isolate the first sub-chamber from the wellbore; and the piston is situated in a second axial position relative to the main housing; to the first configuration. In one or more embodiments, the seal assembly includes: a heating element; and actuating the actuating tool from the second configuration to the first configuration includes degrading, using the heating element, at least a portion of the seal assembly to sealingly disengage the seal assembly. In one or more embodiments, the piston includes: a piston head dividing the chamber into the first and second sub-chambers; and a piston rod connected to the piston head. In one or more embodiments, the actuating tool further includes: a conductive fitting extending through the piston head and between the first and second sub-chambers; and a first electrical conductor connecting the conductive fitting to the seal assembly; and actuating the actuating tool from the second configuration to the first configuration includes communicating electricity, via the first electrical conductor, from the conductive fitting to the seal assembly to sealingly disengage the seal assembly. In one or more embodiments, the actuating tool further includes: a conductor sub connected to the main housing so that, in combination, the main housing and the conductor sub at least partially define the chamber; and a second electrical conductor connecting the conductor sub to the conductive fitting; and actuating the actuating tool from the second configuration to the first configuration further includes communicating electricity, via the second electrical conductor, from the conductor sub to the conductive fitting.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A downhole tool adapted to be positioned into a wellbore, the downhole tool comprising:

an actuating tool, comprising:

a main housing;

a housing retainer connected to the main housing so that, in combination, the main housing and the housing retainer at least partially define a chamber;

a piston extending through the housing retainer and dividing the chamber into first and second sub-chambers;

an auxiliary sleeve connected to the housing retainer, opposite the main housing; and a seal assembly;

and an auxiliary tool connected to the auxiliary sleeve, opposite the housing retainer;

wherein the actuating tool is actuable to:

a first configuration, in which:

the seal assembly is sealingly disengaged from the housing retainer to permit fluid communication, via a first opening in the housing retainer, between the first sub-chamber and the wellbore;

the fluid communication between the first sub-chamber and the wellbore moves the piston to a first axial position relative to the housing retainer; and the movement of the piston to the first axial position actuates the auxiliary tool to a first state.

2. The downhole tool of claim 1, wherein the fluid communication between the first sub-chamber and the wellbore is further permitted via a second opening in the auxiliary sleeve.

3. The downhole tool of claim 1, wherein the actuating tool is further actuable:

from a second configuration, in which:

the seal assembly sealingly engages the housing retainer to fluidically isolate the first sub-chamber from the wellbore;

the piston is situated in a second axial position relative to the housing retainer; and the auxiliary tool is in a second state;

to the first configuration.

4. The downhole tool of claim 3, wherein the seal assembly comprises a heating element; and wherein the heating element is adapted to degrade at least a portion of the seal assembly to sealingly disengage the seal assembly from the housing retainer, thereby actuating the actuating tool from the second configuration to the first configuration.

5. The downhole tool of claim 3, wherein the piston comprises:

a piston head dividing the chamber into the first and second sub-chambers; and a piston rod connected to the piston head and extending through the housing retainer.

6. The downhole tool of claim 5, wherein the actuating tool further comprises:

a conductive fitting extending through the piston head and between the first and second sub-chambers; and a first electrical conductor connecting the conductive fitting to the seal assembly;

and wherein the first electrical conductor is adapted to communicate electricity from the conductive fitting to the seal assembly to sealingly disengage the seal assembly from the housing retainer, thereby actuating the actuating tool from the second configuration to the first configuration.

7. The downhole tool of claim 6, wherein the actuating tool further comprises:

a conductor sub connected to the main housing, opposite the housing retainer, so that, in combination, the main housing, the housing retainer, and the conductor sub define the chamber; and a second electrical conductor connecting the conductor sub to the conductive fitting;

and wherein the second electrical conductor is adapted to communicate electricity from the conductor sub to the conductive fitting.

8. A method, comprising:

positioning a downhole tool into a wellbore, the downhole tool comprising:

an actuating tool, comprising:

a main housing;

a housing retainer connected to the main housing so that, in combination, the main housing and the housing retainer at least partially define a chamber;

a piston extending through the housing retainer and dividing the chamber into first and second sub-chambers;

an auxiliary sleeve connected to the housing retainer, opposite the main housing; and a seal assembly;

and an auxiliary tool connected to the auxiliary sleeve, opposite the housing retainer;

and actuating the actuating tool:

to a first configuration, in which:

the seal assembly is sealingly disengaged from the housing retainer to permit fluid communication, via a first opening in the housing retainer, between the first sub-chamber and the wellbore;

the fluid communication between the first sub-chamber and the wellbore moves the piston to a first axial position relative to the housing retainer; and the movement of the piston to the first axial position actuates the auxiliary tool to a first state.

9. The method of claim 8, wherein the fluid communication between the first sub-chamber and the wellbore is further permitted via a second opening in the auxiliary sleeve.

10. The method of claim 8, further comprising:

actuating the actuating tool:

from a second configuration, in which:

the seal assembly sealingly engages the housing retainer to fluidically isolate the first sub-chamber from the wellbore;

the piston is situated in a second axial position relative to the housing retainer; and the auxiliary tool is in a second state;

to the first configuration.

11. The method of claim 10, wherein the seal assembly comprises a heating element; and wherein actuating the actuating tool from the second configuration to the first configuration comprises degrading, using the heating element, at least a portion of the seal assembly to sealingly disengage the seal assembly from the housing retainer.

12. The method of claim 10, wherein the piston comprises:

a piston head dividing the chamber into the first and second sub-chambers; and a piston rod connected to the piston head and extending through the housing retainer.

13. The method of claim 12, wherein the actuating tool further comprises:

a conductive fitting extending through the piston head and between the first and second sub-chambers; and a first electrical conductor connecting the conductive fitting to the seal assembly;

and wherein actuating the actuating tool from the second configuration to the first configuration comprises communicating electricity, via the first electrical conductor, from the conductive fitting to the seal assembly to sealingly disengage the seal assembly from the housing retainer.

14. The method of claim 13, wherein the actuating tool further comprises:

a conductor sub connected to the main housing, opposite the housing retainer, so that, in combination, the main housing, the housing retainer, and the conductor sub define the chamber; and a second electrical conductor connecting the conductor sub to the conductive fitting;

and wherein actuating the actuating tool from the second configuration to the first configuration further comprises communicating electricity, via the second electrical conductor, from the conductor sub to the conductive fitting.

15. An actuating tool adapted to be positioned into a wellbore, the actuating tool comprising:

a main housing at least partially defining a chamber;

a piston dividing the chamber into first and second sub-chambers; and a seal assembly;

wherein the actuating tool is actuable:

from a second configuration, in which at least a portion of the seal assembly extends within a first opening of the actuating tool;

to a first configuration, in which:

the seal assembly is sealingly disengaged to permit fluid communication, via the first opening, between the first sub-chamber and the wellbore; and the fluid communication between the first sub-chamber and the wellbore moves the piston to a first axial position relative to the main housing;

wherein the actuating tool further comprises a housing retainer connected to the main housing so that, in combination, the main housing and the housing retainer at least partially define the chamber; and wherein the first opening is formed in the housing retainer.

16. The actuating tool of claim 15, wherein, in the second configuration of the actuating tool:

the seal assembly is sealingly engaged to fluidically isolate the first sub-chamber from the wellbore; and the piston is situated in a second axial position relative to the main housing.

17. An actuating tool adapted to be positioned into a wellbore, the actuating tool comprising:

a main housing at least partially defining a chamber;

a piston dividing the chamber into first and second sub-chambers; and a seal assembly;

wherein the actuating tool is actuable to:

a first configuration, in which:

the seal assembly is sealingly disengaged to permit fluid communication, via a first opening, between the first sub-chamber and the wellbore; and the fluid communication between the first sub-chamber and the wellbore moves the piston to a first axial position relative to the main housing;

wherein the actuating tool further comprises a housing retainer connected to the main housing so that, in combination, the main housing and the housing retainer at least partially define the chamber;

wherein the first opening is formed in the housing retainer;

wherein the actuating tool further comprises an auxiliary sleeve connected to the housing retainer, opposite the main housing; and wherein the fluid communication between the first sub-chamber and the wellbore is further permitted via a second opening in the auxiliary sleeve.

18. An actuating tool adapted to be positioned into a wellbore, the actuating tool comprising:

a main housing at least partially defining a chamber;

a piston dividing the chamber into first and second sub-chambers; and a seal assembly;

wherein the actuating tool is actuable:

from a second configuration, in which:

the seal assembly is sealingly engaged to fluidically isolate the first sub-chamber from the wellbore; and the piston is situated in a second axial position relative to the main housing;

to a first configuration, in which:

the seal assembly is sealingly disengaged to permit fluid communication, via a first opening, between the first sub-chamber and the wellbore; and the fluid communication between the first sub-chamber and the wellbore moves the piston to a first axial position relative to the main housing;

wherein the seal assembly comprises a heating element; and wherein the heating element is adapted to degrade at least a portion of the seal assembly to sealingly disengage the seal assembly, thereby actuating the actuating tool from the second configuration to the first configuration.

19. An actuating tool adapted to be positioned into a wellbore, the actuating tool comprising:

a main housing at least partially defining a chamber;

a piston dividing the chamber into first and second sub-chambers; and a seal assembly;

wherein the actuating tool is actuable:

from a second configuration, in which:

at least a portion of the seal assembly extends within a first opening of the actuating tool;

the seal assembly is sealingly engaged to fluidically isolate the first sub-chamber from the wellbore; and the piston is situated in a second axial position relative to the main housing;

to a first configuration, in which:

the seal assembly is sealingly disengaged to permit fluid communication, via the first opening, between the first sub-chamber and the wellbore; and the fluid communication between the first sub-chamber and the wellbore moves the piston to a first axial position relative to the main housing;

and wherein the piston comprises:

a piston head dividing the chamber into the first and second sub-chambers; and a piston rod connected to the piston head.

20. An actuating tool adapted to be positioned into a wellbore, the actuating tool comprising:

a main housing at least partially defining a chamber;

a piston dividing the chamber into first and second sub-chambers; and a seal assembly;

wherein the actuating tool is actuable:

from a second configuration, in which:

the seal assembly is sealingly engaged to fluidically isolate the first sub-chamber from the wellbore; and the piston is situated in a second axial position relative to the main housing;

to a first configuration, in which:

the seal assembly is sealingly disengaged to permit fluid communication, via a first opening, between the first sub-chamber and the wellbore; and the fluid communication between the first sub-chamber and the wellbore moves the piston to a first axial position relative to the main housing;

wherein the piston comprises:

a piston head dividing the chamber into the first and second sub-chambers; and a piston rod connected to the piston head;

wherein the actuating tool further comprises:

a conductive fitting extending through the piston head and between the first and second sub-chambers; and a first electrical conductor connecting the conductive fitting to the seal assembly;

and wherein the first electrical conductor is adapted to communicate electricity from the conductive fitting to the seal assembly to sealingly disengage the seal assembly, thereby actuating the actuating tool from the second configuration to the first configuration.

21. The actuating tool of claim 20, wherein the actuating tool further comprises:

a conductor sub connected to the main housing so that, in combination, the main housing and the conductor sub at least partially define the chamber; and a second electrical conductor connecting the conductor sub to the conductive fitting;

and wherein the second electrical conductor is adapted to communicate electricity from the conductor sub to the conductive fitting.

22. A method, comprising:

positioning an actuating tool into a wellbore, the actuating tool comprising:

a main housing at least partially defining a chamber;

a piston dividing the chamber into first and second sub-chambers; and a seal assembly;

and actuating the actuating tool:

from a second configuration, in which at least a portion of the seal assembly extends within a first opening of the actuating tool;

to a first configuration, in which:

the seal assembly is sealingly disengaged to permit fluid communication, via the first opening, between the first sub-chamber and the wellbore; and the fluid communication between the first sub-chamber and the wellbore moves the piston to a first axial position relative to the main housing;

wherein the actuating tool further comprises a housing retainer connected to the main housing so that, in combination, the main housing and the housing retainer at least partially define the chamber; and wherein the first opening is formed in the housing retainer.

23. A method, comprising:

positioning an actuating tool into a wellbore, the actuating tool comprising:

a main housing at least partially defining a chamber;

a piston dividing the chamber into first and second sub-chambers; and a seal assembly;

and actuating the actuating tool:

to a first configuration, in which:

the seal assembly is sealingly disengaged to permit fluid communication, via a first opening, between the first sub-chamber and the wellbore; and the fluid communication between the first sub-chamber and the wellbore moves the piston to a first axial position relative to the main housing;

wherein the actuating tool further comprises a housing retainer connected to the main housing so that, in combination, the main housing and the housing retainer at least partially define the chamber;

wherein the first opening is formed in the housing retainer;

wherein the actuating tool further comprises an auxiliary sleeve connected to the housing retainer, opposite the main housing; and wherein the fluid communication between the first sub-chamber and the wellbore is further permitted via a second opening in the auxiliary sleeve.

24. The method of claim 22, wherein, in the second configuration of the actuating tool:

the seal assembly is sealingly engaged to fluidically isolate the first sub-chamber from the wellbore; and the piston is situated in a second axial position relative to the main housing.

25. A method, comprising:

positioning an actuating tool into a wellbore, the actuating tool comprising:

a main housing at least partially defining a chamber;

a piston dividing the chamber into first and second sub-chambers; and a seal assembly;

and actuating the actuating tool:

from a second configuration, in which:

the seal assembly is sealingly engaged to fluidically isolate the first sub-chamber from the wellbore; and the piston is situated in a second axial position relative to the main housing;

to a first configuration, in which:

the seal assembly is sealingly disengaged to permit fluid communication, via a first opening, between the first sub-chamber and the wellbore; and the fluid communication between the first sub-chamber and the wellbore moves the piston to a first axial position relative to the main housing;

wherein the seal assembly comprises a heating element; and wherein actuating the actuating tool from the second configuration to the first configuration comprises degrading, using the heating element, at least a portion of the seal assembly to sealingly disengage the seal assembly.

26. A method, comprising:

positioning an actuating tool into a wellbore, the actuating tool comprising:

a main housing at least partially defining a chamber;
a piston dividing the chamber into first and second sub-chambers; and
a seal assembly;
and
actuating the actuating tool:
from a second configuration, in which:
at least a portion of the seal assembly extends within a first opening of the actuating tool;
the seal assembly is sealingly engaged to fluidically isolate the first sub-chamber from the wellbore; and
the piston is situated in a second axial position relative to the main housing;
to a first configuration, in which:
the seal assembly is sealingly disengaged to permit fluid communication, via the first opening, between the first sub-chamber and the wellbore; and
the fluid communication between the first sub-chamber and the wellbore moves the piston to a first axial position relative to the main housing;
wherein the piston comprises:
a piston head dividing the chamber into the first and second sub-chambers; and
a piston rod connected to the piston head.

27. A method, comprising:
positioning an actuating tool into a wellbore, the actuating tool comprising:
a main housing at least partially defining a chamber;
a piston dividing the chamber into first and second sub-chambers; and
a seal assembly;
and
actuating the actuating tool:
from a second configuration, in which:
the seal assembly is sealingly engaged to fluidically isolate the first sub-chamber from the wellbore; and
the piston is situated in a second axial position relative to the main housing;
to a first configuration, in which:
the seal assembly is sealingly disengaged to permit fluid communication, via a first opening, between the first sub-chamber and the wellbore; and
the fluid communication between the first sub-chamber and the wellbore moves the piston to a first axial position relative to the main housing;
wherein the piston comprises:
a piston head dividing the chamber into the first and second sub-chambers; and
a piston rod connected to the piston head;
wherein the actuating tool further comprises:
a conductive fitting extending through the piston head and between the first and second sub-chambers; and
a first electrical conductor connecting the conductive fitting to the seal assembly;
and
wherein actuating the actuating tool from the second configuration to the first configuration comprises communicating electricity, via the first electrical conductor, from the conductive fitting to the seal assembly to sealingly disengage the seal assembly.

28. The method of claim 27,
wherein the actuating tool further comprises:
a conductor sub connected to the main housing so that, in combination, the main housing and the conductor sub at least partially define the chamber; and
a second electrical conductor connecting the conductor sub to the conductive fitting;
and
wherein actuating the actuating tool from the second configuration to the first configuration further comprises communicating electricity, via the second electrical conductor, from the conductor sub to the conductive fitting.

* * * * *